United States Patent [19]

Hennequin

[11] Patent Number: 4,475,580

[45] Date of Patent: Oct. 9, 1984

[54] MECHANISM FOR A ROLLER BLIND

[75] Inventor: Petrus J. Hennequin, Rotterdam, Netherlands

[73] Assignee: Hunter Douglas International N.V., Curacao, Netherlands Antilles

[21] Appl. No.: 522,553

[22] Filed: Aug. 12, 1983

Related U.S. Application Data

[63] Continuation of Ser. No. 266,102, Jan. 19, 1981.

[30] Foreign Application Priority Data

Jan. 17, 1980 [DE] Fed. Rep. of Germany ..... 3001489

[51] Int. Cl.[3] ..... E06B 9/208

[52] U.S. Cl. ..... 160/308; 160/321

[58] Field of Search ..... 160/321, 308

[56] References Cited

U.S. PATENT DOCUMENTS

| | | | |
|---|---|---|---|
| 569,563 | 10/1896 | Neal | 248/270 |
| 2,112,247 | 3/1938 | McLoughlin | 24/214 |
| 2,226,502 | 12/1940 | Platt | 24/116 A |
| 2,577,046 | 12/1951 | Svirsky | 160/321 |
| 2,724,881 | 11/1955 | Di Maria | 24/116 A |
| 2,894,578 | 7/1959 | Caesar et al. . | |
| 3,424,224 | 1/1969 | Lowe | 160/308 |
| 3,854,517 | 12/1974 | Nakamura | 160/321 |
| 4,139,044 | 2/1979 | Brolin | 160/321 |

*Primary Examiner*—Ramon S. Britts
*Assistant Examiner*—Cherney S. Lieberman
*Attorney, Agent, or Firm*—Pennie & Edmonds

[57] ABSTRACT

A mechanism for the roller of a roller blind, in which a housing has rotatably mounted therein a pulley over which a ball cord, passes, with two pieces of cord hanging down, one from each side of the pulley. The balls of the ball cord can be engaged in one of two U-shaped slots, to lock the cord. The U-shaped slots are each formed in a locking element which is designed as a component which can be fastened to the housing in either of two different positions, the locking part being arranged on the locking element in such a way that, in one or other of the two different positions, it always interacts with one or the other of the pieces of cord hanging down.

8 Claims, 7 Drawing Figures

MECHANISM FOR A ROLLER BLIND

DESCRIPTION

This application is a continuation of application Ser. No. 226,102, filed Jan. 19, 1981.

The invention relates to a mechanism for a roller blind.

One form of roller blind has a cord pulley mounted on the end of the roller and located in a housing, a ball cord being taken around the cord pulley. A locking element is mounted on the housing and interacts with one of the two pieces of cord which hang down, one on either side of the pulley, and has a locking part which has a U-shaped slot the width of which is less than the diameter of the balls.

In a mechanism of this type, the pieces of cord are in general a part of one single endless ball cord which is taken around the cord pulley. If the roller of the blind is mounted, for example, above a window, the two pieces of cord are located approximately one behind the other, as viewed by a person standing in front of the window. To pull up the roller blind, one of the pieces of cord must be pulled down. The other piece of cord moves correspondingly upwards. At the desired height, a ball of the piece of cord which has been pulled, engages in the locking part so that the roller blind cannot unroll downwards due to its mere weight. If the roller blind is to be pulled a little further up or is to be let down, it is necessary to pull the piece of cord held by the locking part, at which time the piece of cord must first be released from its engagement with the locking part.

A roller blind can be designed in such a way that, as viewed from the operator's position, it runs either in front of or behind the roller. Accordingly, different directions of rotation are required for the mechanism of the roller. It is then also necessary, however, that the locking element be arranged in a different position. Furthermore, the resulting position of the locking element also depends on whether the mechanism is to be mounted on the right-hand or left-hand end of the roller.

The known mechanism has the disadvantage that its locking element has a fixed predetermined position relative to the axis of the roller. Such a mechanism can therefore not be used for all the possible versions, both with respect to the particular direction of rotation and with respect to the end of the roller envisaged for mounting.

According to the present invention there is provided a mechanism for a roller blind, said mechanism comprising a housing, a cord pulley rotatably mounted in the housing, a ball cord passed over the cord pulley, so as to have two pieces of cord hanging down, one from each side of the pulley, and a locking element which is located on the housing and interacts with one of the two pieces of cord hanging down and has a locking part which has a U-shaped slot engageable between two adjacent balls of the cord, the locking element being designed as a component which can be fastened to the housing in either of two different positions, and the locking part being arranged on the locking element in such a way that, in one or the other of the two different fastened positions, it always interacts with one or the other of the pieces of cord hanging down.

The result of the design of the mechanism in accordance with the invention is that the locking element and the locking part are brought into the particular required position and can interact as required with the particular piece of cord which is to be pulled for actuating the roller blind. The applicability of the mechanism is therefore independent of the particular requisite direction of rotation. Furthermore, however, it is also advantageous that the same mechanism can be used as required for the right-hand or left-hand end of the roller, since the locking element with the locking part can also be brought into the particular position required for this purpose.

In the following text, one advantageous embodiment of the invention is described in more detail, in which the locking element has two U-shaped locking parts which open in opposite directions, one or the other locking part interacting with one piece of cord in one fastened position of the locking element and with the other piece of cord in the other fastened position of the locking element, as required, and the two locking parts being located on one side of the vertical axis passing through the centre of the housing.

The result of this design is that two locking parts which can be used selectively are available in each case for interaction with one of the pieces of cord hanging down. Since the two locking parts open in different directions, that locking part can be used in each case, for which an easier movement of the piece of cord results on release from the locked position. In general, it would probably be easier to pull the piece of cord a little towards oneself in order to release this engagement. Independently of this fact, however, it is also possible to use that locking part in each case, with which the engagement of the particular piece of cord can be effected more readily or even automatically.

In a preferred construction according to the invention, the locking part nearer to the vertical axis passing through the centre of the housing merges into a through passage, the diameter of which is greater than that of the balls and which passes through the locking element in an approximately vertical direction, and through which the piece of cord associated with this locking part is taken.

In this case, a locking part which is located in the zone below the cord pulley is thus available for interaction with the piece of cord to be actuated. When the ball cord interacts with this locking part, it is deflected a little from the vertical towards the vertical axis passing through the housing. With the aid of the through passage, the ball cord is thus reliably guided. It is advantageous in this connection when the locking element wall forming the through passage has a slot through which the ball cord can be inserted into the through passage. An endless ball cord then does not have to be undone when it is to be inserted into the through passage.

Preferably, at least one of the locking parts is formed with a cam surface on its side facing the cord pulley and the slope of the cam surface is selected such that, when the associated piece of cord is pulled down, the ball held by the locking part is forced out of the latter.

This design ensures an automatic release of the engagement with the locking part, solely by pulling the particular piece of cord downwards. The vertical pulling force is then partially converted to a horizontal force component which effects a corresponding lateral movement of the particular ball gliding along the upper side of the locking part.

Desirably, the housing has two arms extending at least approximately in the radial direction, relative to the axis of rotation of the cord pulley, the locking element being locatable between or positionable over the arms in the first position or in the second position in which it is rotated through 180° with respect thereto about a vertical axis, and the locking element can be locked in its particular operating position. In this way, easy and reliable fixing of the locking element in the particular requisite position is facilitated.

Preferably, the housing and the locking element are mutually connected by a detent lock, either one of said arms or the side of the locking element facing the arms having a recess, a detent stud being formed on the particular side of the locking element or on the arm, and the detent studs, on assembly of the locking element, flexing the arms utilizing the elasticity of the material, until the detent studs engage in their particular associated recesses. To release this connection, the arms are bent by hand or by means of a tool until the detent stud or studs is or are released from the particular recess.

In order to prevent an uncontrolled release of the engagement between the locking part and the ball cord, one of said at least one locking parts of the locking element further comprises, at a location below the sloping cam surface forming the upper surface, a downwardly opening recess which, as viewed from below, extends at least slightly further upwards than the lower edge of the locking part and in which a ball of the ball cord partially engages when locking is operative.

Furthermore, the U-shaped locking parts can each be formed and arranged in such a way that the balls of the ball cord, when released after a proceding pull, automatically engage under the action of gravity to a position in which one of the balls will engage in the particular associated locking part. It is thus only necessary to let the ball cord go without effecting any additional movement in order to arrest the roller blind at the particular desired height.

Preferably, the housing, on that side which is opposite a drive pin interacting with the roller of the roller blind is provided with projections by means of which the housing can be inserted into a bracket in different positions, each mutually offset by 90°.

This design enables the bracket of the roller blind to be selectively fixed to the ceiling or to the wall of a room and, at the same time, the housing of the mechanism to be joined to the bracket in the requisite position in either case.

In order that the invention will be more fully understood, the following description is given, merely by way of example, reference being made to the accompanying drawings in which.

Figure 1:
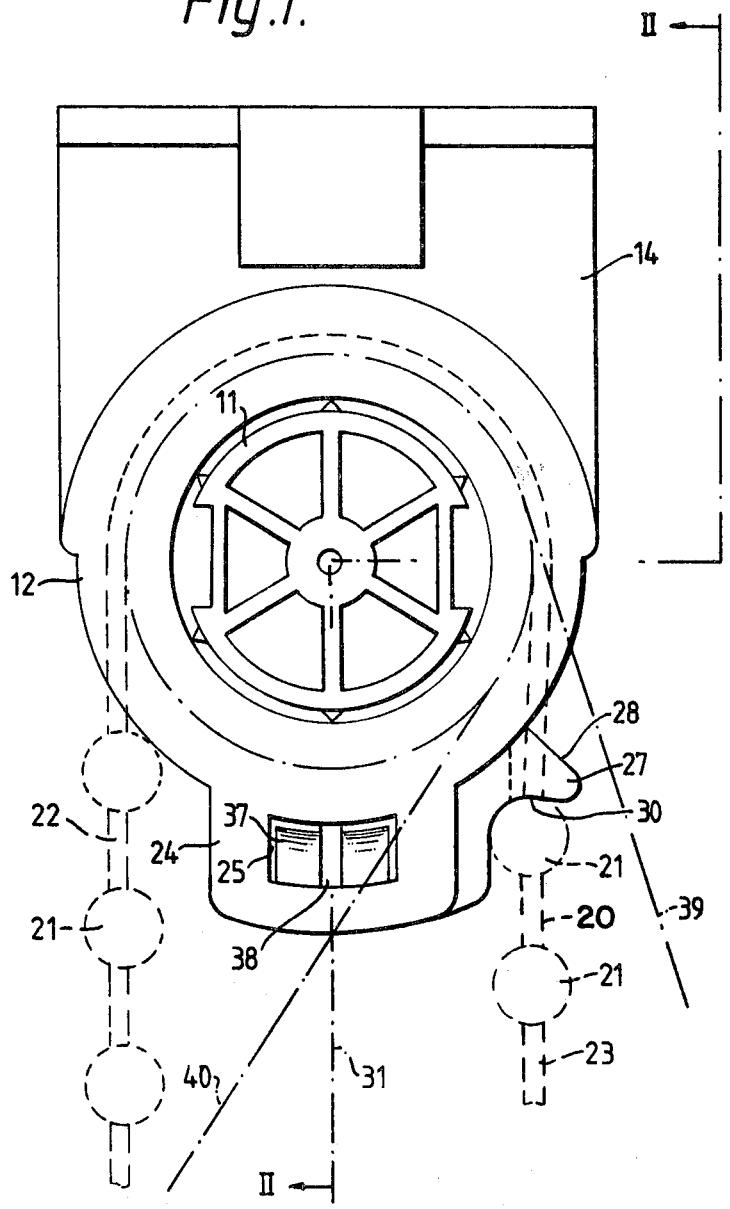
FIG. 1 is an elevation of one embodiment of roller blind mechanism according to the invention, as viewed in the axial direction of a roller adapted to be supported by the mechanism where the mechanism includes a bracket, a housing and a locking element.
Figure 2:
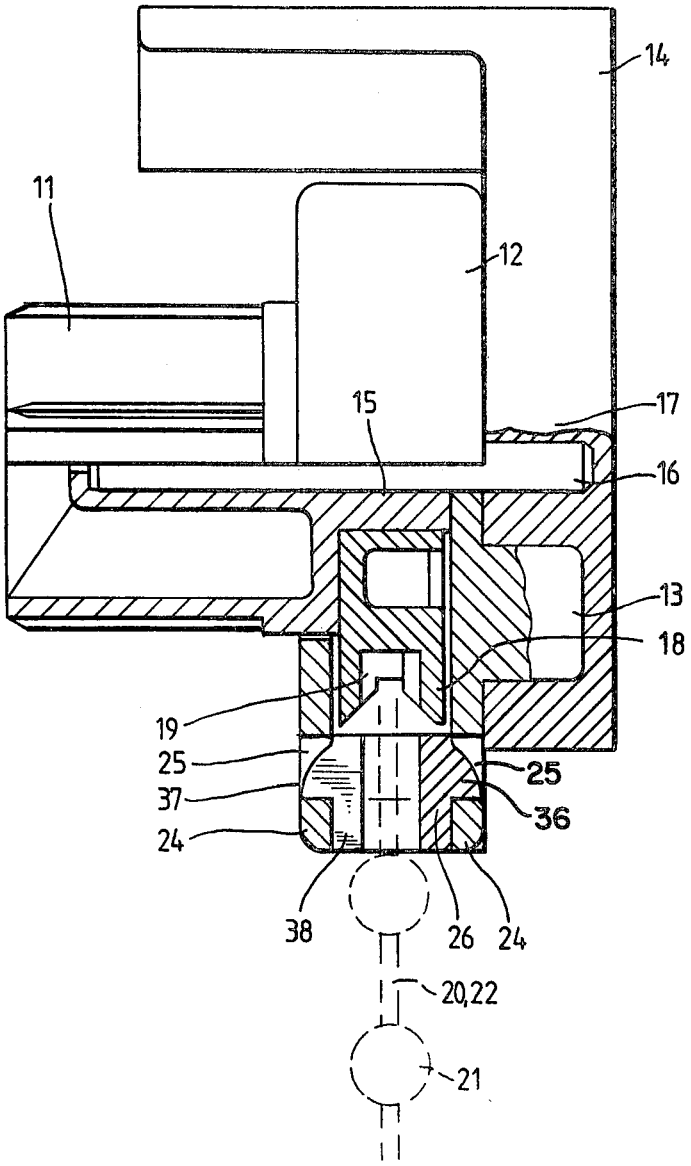
FIG. 2 is a front elevation, partly in section and taken along the line II—II in FIG. 1.
Figure 3:
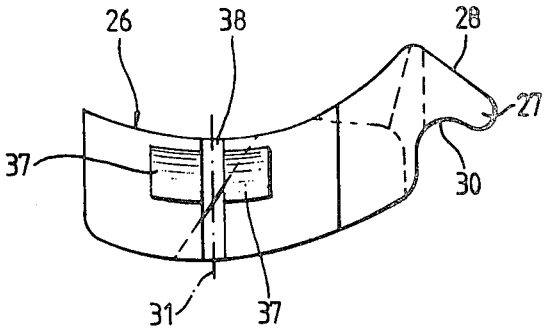
FIG. 3 is a view of the locking element, corresponding to the operating position shown in FIG. 1.
Figure 7:
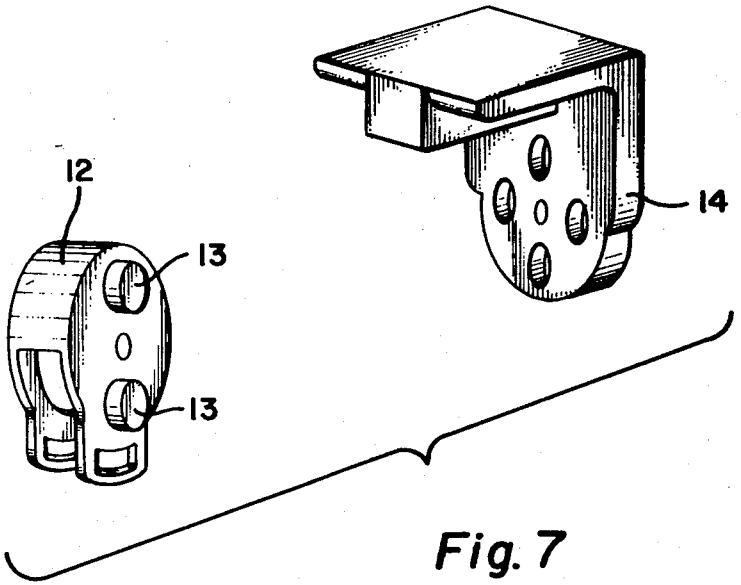
FIG. 7 is a perspective view of the housing and bracket prior to assembly.

FIGS. 1 and 2 show a roller blind mechanism having a pin 11 adapted to be push fitted onto a roller, not shown. The pin 11 protrudes from one side of a housing 12 having two housing walls which housing is provided with projections 13 on its housing wall opposite the pin 11. An angled bracket 14 is provided, on its side facing the housing 12, with a number of recesses which are not represented here in detail, the recesses being arranged in such a way that the housing 12 can, with the aid of the projections 13, be joined to the bracket 14 either in the position shown in FIGS. 1 and 2 or in such a position that the bracket 14 is rotated through 90° relative to the position shown in FIGS. 1, 2 and 7 about the axis of a roller.

The pin 11 has a reduced diameter portion 15 which extends into the interior of the housing 12 and the free end face of which is adjacent to the right hand inside surface of the housing 12, shown in FIG. 2. Through the portion 15 and the axially outer part of the pin, passes a shaft 16 which protrudes from the housing 12 on its side facing the bracket 14 and engages in a bearing bush 17 on the inside of the bracket 14.

A cord pulley 18 which, on its outer circumference, is provided with cavities 19 in a uniform distribution, is mounted and secured against rotation, on the reduced diameter portion 15 of the pin 11. At regular spacings, a ball cord 20 has balls 21, each of which engages in one of the cavities 19 when revolving around the cord pulley 18. The ball cord 20 runs in a closed configuration, that is to say it is endless. For a clearer distinction within the scope of the description, the left-hand part of the ball cord 20 in FIG. 1 is designated as the piece of cord 22, whilst the right-hand part is designated as the piece of cord 23.

As an extension of its two housing walls, the housing 12 has two radial, vertically downward-pointing arms 24 each of which is provided with a recess 25. A locking element 26 which is described below with reference, in particular, to FIGS. 3–6, can be inserted between the arms 24.

On one of its sides, the locking element 26 has a first locking part 27, provided on its upper side with a sloping cam surface 28. The locking part 27 has a U-shaped slot 29 which is open towards the outside. Moreover, on its underside, the locking part 27 has a recessed zone 30 which extends up to a greater height than the lower tip of the locking part 27.

An axis passing vertically through the centre of the housing 12 is marked with the reference numeral 31. The position of this axis 31 is also indicated in FIGS. 3–6. The locking element 26 has a second locking part 32 which, in relation to the axis 31, is located on the same side as the locking part 27. The locking part 32, however, has a slot 33 which provides the locking part 32 with a U-shape which is open in the direction of the axis 31. The slot 33 opens into a through passage 34, the width of which is such that the balls 21 can readily pass through. By contrast, the slot 29 of the locking part 27 and the slot 33 of the locking part 32 are so narrow that the balls 21 cannot pass.

Figure 4:
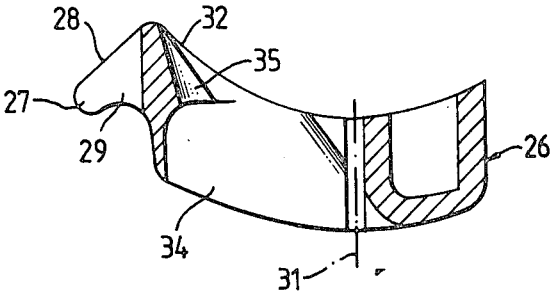
FIG. 4 is a section through the locking element as viewed from the opposite direction from FIG. 3.
Figure 5:
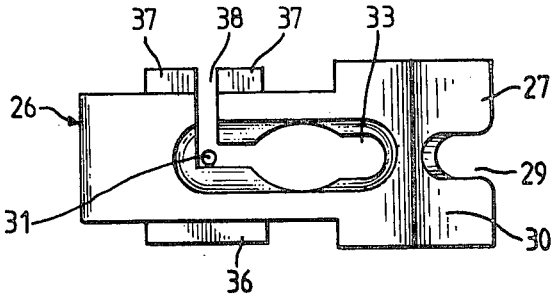
FIG. 5 is an underneath plan of the locking element shown in FIG. 3.
Figure 6:
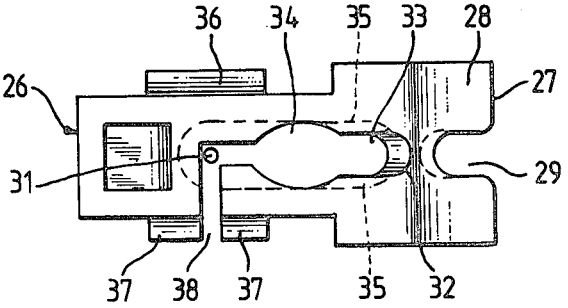
FIG. 6 is a top plan view of the locking element shown in FIG. 3.

As can best be seen from FIG. 4, the second locking part 32 has, on its upper side, a downward-sloping cam surface 35, by means of which a ball 21 coming into contact therewith can be moved in the direction of the through passage 34, so that an engagement with the locking part 32 is thus released.

On one of its sides, the locking element 26 has a detent stud 36, the shape and size of which are adapted to the recess 25 in the associated arm 24. Thus, the detent stud 36 has vertical side faces and upper and lower faces which are adapted to the particular radius.

On the opposite side of the locking element 26, two detent studs 37 are provided which, in the shape and size of their combined external outline, also correspond to a recess 25. Between the two detent studs 37, a vertical slot 38 is present which passes in this zone through the wall of the locking element and leads to the through passage 34. The cord of the ball cord 20 can thus be introduced into the through passage 34 via the slot 38.

On their sides facing the arms 24, the detent studs 36 and 37 are inclined, and in particular in such a way that they have a wedge-shaped cross-section which tapers in the direction of insertion of the locking element 26. This can best be seen in FIG. 2. On insertion of the locking element 26, the arms 24 will splay apart until the detent studs 36 and 37 can engage in the associated recesses 25. Since most of the parts of the mechanism, and in particular the housing 12, will in general consist of plastic, a sufficient elasticity of the material is present.

In operation, referring to FIG. 1, the locking element 26 is mounted on the casing in a way which corresponds to clockwise rolling-up of the roller blind. The piece of cord 23 hangs down vertically, the cord passing through the incision or U-shaped slot 29 of the locking part 27. A ball 21 is in contact with the underside of the locking part 27 in the recessed zone 30.

If the piece of cord 23 is now pulled down in order to actuate the roller blind, the next higher ball 21 comes into contact with the cam surface 28 and is forced away outwards by the pulling movement. This automatically effects a release of the ball engaged with the locking part 27. During actuation, the piece of cord 23 is advantageously brought into an oblique position, as indicated by the dotted-and-dashed line 39. The roller blind can then be let down or pulled up. On release, the piece of cord 23 will tend, due to gravity, to return to the vertical position. One of the balls 21 is thus automatically again brought into engagement with the locking part 27.

If, on that side of the housing 12 which is on the right in FIG. 1, a wall or another obstacle is present in the immediate vicinity, so that adequate free space is not available for deflecting the piece of cord 23 in the direction of the line 39, the locking part 32 can be used instead of locking part 27. For this mode of operation, the ball cord 20 is shown in broken lines. The ball cord 20 is introduced into the through passage 34 via the slot 38. Due to the deflection of the piece of cord 23 from the vertical and due to the alignment of the locking part 32, the piece of cord 23 will always automatically engage in the locking part 32 since, in this case also, the piece of cord 23 will, due to gravity, tend to return to the vertical position.

If the piece of cord 23 is pulled down, the particular next higher ball 21 moves along the cam surface 35 towards the side until it reaches the through passage 34. The engagement of the locking part 32 is thus released. The roller blind can be pulled up even if the piece of cord 23 is pulled down in an approximately vertical direction.

However, it is advantageous, and absolutely necessary for letting the roller blind down, to bring the piece of cord 23 approximately into the position shown by the line 40. The roller blind can then be adjusted without effort in either direction. After release of the piece of cord 23, one of the balls 21 thereof again automatically comes into contact with the locking part 32.

It need not be explained in more detail that a corresponding functioning sequence results in conjunction with the piece of cord 22, if the locking element 26 is fixed to the casing 12 in a position rotated through 180°, corresponding to that shown in FIG. 4.

I claim:

1. A mechanism for a roller blind, said mechanism comprising a housing, a cord pulley rotatably mounted in the housing, a ball cord passed over the cord pulley so as to have two pieces of cord hanging down, one from each side of the pulley, and a locking element which is located on the housing and interacts with one of the two pieces of cord hanging down, said locking element including two locking parts each having a U-shaped slot engagable between two adjacent balls of the cord, the locking element being in the form of a component which is reversibly fastened to the housing in either of two different positions to accommodate rotation of the roller blind in either of two directions and the locking element when in one or the other of the two different positions being fastened at a location whereby each locking part is disposed effective always to interact with one piece of cord in one fastened position of the locking element and with the other piece of the cord in the other fastened position of the locking element and the two locking parts being on the same side of a vertical plane passing through the centre of the housing and parallel to the axis of rotation of the cord pulley.

2. A mechanism as claimed in claim 1 and further comprising a through passage in the locking element, the diameter of said through passage being greater than that of the balls and said through passage passing through the locking element in an approximately vertical direction, said through passage merging with the locking part nearer to the vertical plane passing through the centre of the housing, the piece of cord associated with the locking part passing through the through passage.

3. A mechanism as claimed in claim 2, wherein the locking element has a wall with a slot therein which leads to the through passage and through which the ball cord can be inserted into the through passage.

4. A mechanism as claimed in claim 1 wherein at least one locking part of the locking element further comprises a cam surface on its side facing the cord pulley, the slope of the cam surface being selected such that, when an associate piece of cord is pulled down, a ball is forced out of said at least one locking part, and one of said locking parts of the locking element further comprising, at a location below the sloping cam surface forming an upper surface, a downwardly opening recess which, as viewed from below, extends at least slightly further upwards than the lower edge of the locking part and in which a ball carrier partially engages when locking is operative.

5. A mechanism as claimed in claim 7, and further comprising a detent lock mutually connecting an arm of the housing and the locking element, and wherein said detent lock comprises means defining a recess, and a detent stud, whereby, on assembly of the locking element, said detent studs flex the arm, utilizing the elasticity of the material, until the detent studs engage in their particular associated recesses.

6. A mechanism as claimed in claim 1 wherein the U-shaped locking parts are each shaped and disposed in such a way whereby the balls of the ball cord, when released after a preceding pull, automatically fall under the influence of gravity to a position in which one of the balls will engage in the particular associated locking part.

7. A mechanism for a roller blind, said mechanism comprising a housing, a cord pulley rotatably mounted in the housing, a ball cord passed over the cord pulley so as to have two pieces of cord hanging down, one from each side of the pulley, a locking element which is located on the housing and interacts with one of the two pieces of cord hanging down, said locking element including two locking parts each having a U-shaped slot engagable between two adjacent balls of the cord, the locking element being in the form of a component which is reversibly fastened to the housing in either of two different positions to accommodate rotation of the roller blind in either of two directions and the locking element when in one or the other of the two different positions being fastened at a location whereby each locking part is disposed effective always to interact with one or the other of said pieces of cord hanging down, and wherein said housing comprises two arms extending at least approximately in the radial direction, relative to the axis of rotation of the cord pulley, the locking element being adapted to be engaged by said arms in the first position or in the second position in which it is rotated through 180° with respect thereto about a vertical axis, whereby the locking element can be locked in its particular operating position.

8. A mechanism for a roller blind, said mechanism comprising a housing, a cord pulley rotatably mounted in the housing, a ball cord passed over the cord pulley so as to have two pieces of cord hanging down, one from each side of the pulley, a locking element which is located on the housing and interacts with one of the two pieces of cord hanging down, said locking element including two locking parts each having a U-shaped slot engagable between two adjacent balls of the cord, the locking element being in the form of a component which is reversibly fastened to the housing in either of two different positions to accommodate rotation of the roller blind in either of two directions and the locking element when in one or the other of the two different positions being fastened at a location whereby each locking part is disposed effective always to interact with one or the other of said pieces of cord hanging down, and a drive pin adapted to fit in a roller, a bracket and, on that side of the housing which is opposite the drive pin, projections by means of which the housing can be inserted into said bracket in different positions, each of said positions of which will be offset by 90°.

* * * * *